US008763528B2

(12) United States Patent
Elkinson et al.

(10) Patent No.: US 8,763,528 B2
(45) Date of Patent: Jul. 1, 2014

(54) CLOSED LOOP COLOR CONTROL OF SELECTED REGIONS USING SOLID COLOR REGIONS WITHIN IMAGES

(75) Inventors: Brian Robert Elkinson, Barrington, NH (US); Michael Raymond Rancourt, Merrimack, NH (US); Howard Hoff, Lee, NH (US)

(73) Assignee: Goss International Americas, Inc., Durham, NH (US)

( * ) Notice: Subject to any disclaimer, the term of this patent is extended or adjusted under 35 U.S.C. 154(b) by 331 days.

(21) Appl. No.: 12/964,424

(22) Filed: Dec. 9, 2010

(65) Prior Publication Data

US 2012/0145018 A1 Jun. 14, 2012

(51) Int. Cl.
*B41F 33/00* (2006.01)

(52) U.S. Cl.
USPC ..... 101/483; 101/484

(58) Field of Classification Search
USPC ..... 101/483, 484
See application file for complete search history.

(56) References Cited

U.S. PATENT DOCUMENTS

| | | | | |
|---|---|---|---|---|
| 4,947,348 | A * | 8/1990 | Van Arsdell | 358/1.9 |
| 5,774,225 | A | 6/1998 | Goldstein et al. | |
| 5,791,251 | A | 8/1998 | Kistler et al. | |
| 5,967,050 | A * | 10/1999 | Seymour | 101/484 |
| 6,880,457 | B2 * | 4/2005 | Roesch et al. | 101/38.1 |
| 7,171,900 | B2 | 2/2007 | Niemiro | |
| 7,477,420 | B2 | 1/2009 | Friedman et al. | |
| 7,652,792 | B2 | 1/2010 | Honeck et al. | |
| 2001/0030758 | A1 | 10/2001 | Wendt et al. | |
| 2003/0019382 | A1 | 1/2003 | Furukawa | |
| 2003/0070570 | A1 * | 4/2003 | Yamamoto et al. | 101/365 |
| 2003/0084800 | A1 * | 5/2003 | Anweiler et al. | 101/350.1 |
| 2004/0000241 | A1 * | 1/2004 | Kiyohara | 101/135 |
| 2004/0159254 | A1 * | 8/2004 | Mogi et al. | 101/484 |
| 2004/0173111 | A1 * | 9/2004 | Okuda | 101/211 |
| 2004/0177783 | A1 * | 9/2004 | Seymour | 101/484 |

(Continued)

FOREIGN PATENT DOCUMENTS

| | | | |
|---|---|---|---|
| DE | 199 40 879 | A1 | 3/2001 |
| DE | 10 2008 007037 | A1 | 4/2008 |
| EP | 1 512 531 | A1 | 3/2005 |

OTHER PUBLICATIONS

Extended European Search Report of corresponding European application EP 11 19 2799.

*Primary Examiner* — David Banh
(74) *Attorney, Agent, or Firm* — Davidson, Davidson & Kappel, LLC

(57) ABSTRACT

A color control system for use in a printing press is provided. The system includes a controller for reviewing digital data for a print job and identifying solid color regions of the print job that are greater than a predetermined size, a user interface allowing an operator to select solid color regions identified by the controller, a sensor for measuring a characteristic of the selected solid color regions of the print job on a printed substrate, the controller determining measured values of the characteristic for each of the selected solid color regions, and at least one inking unit for supplying ink in a plurality of ink zones to a plate cylinder, the controller varying the ink supplied to ink zones including the solid color regions as function of a difference between the measured value of the characteristic of each selected solid color region and a predetermined target value of the characteristic. A method for controlling printing of a printing press is also provided.

18 Claims, 4 Drawing Sheets

(56) References Cited

U.S. PATENT DOCUMENTS

| | | | | |
|---|---|---|---|---|
| 2006/0027768 | A1* | 2/2006 | Pearson et al. | 250/559.44 |
| 2006/0092473 | A1 | 5/2006 | Takemoto et al. | |
| 2006/0170996 | A1 | 8/2006 | Headley et al. | |
| 2007/0051161 | A1 | 3/2007 | Friedman et al. | |
| 2007/0125246 | A1* | 6/2007 | Dawley et al. | 101/147 |
| 2008/0127849 | A1* | 6/2008 | Sugimoto | 101/484 |
| 2008/0216695 | A1* | 9/2008 | Ozaki et al. | 101/484 |
| 2009/0128590 | A1 | 5/2009 | Nagai | |

* cited by examiner

CLOSED LOOP COLOR CONTROL OF SELECTED REGIONS USING SOLID COLOR REGIONS WITHIN IMAGES

The present invention relates generally to printing presses and more specifically to color control systems in web offset lithographic printing presses.

BACKGROUND OF INVENTION

Closed loop color control in web offset lithography is most commonly accomplished by detecting optical density of color bars, which are arrays of solid patches on a paper substrate printed outside of the desired printed image. Each color bar is a continuous color target reference which is printed outside of the desired printed image and is present for every print zone in circumferentially the same position. Sensors measure the color bar and a controller adjusts the flow of ink in each ink zone of the inking unit based on the measured values of the color bar and target values. The flow ink into the ink zones is adjusted by adjusting the opening amount of ink keys in open fountain inking units or by adjusting the pulse rates of ink valves in digital ink rail inking units. U.S. Patent Publication 2007/0151470, which is hereby incorporated by reference herein, describes an open fountain inking unit that includes a plurality of ink keys (i.e., "screws") and U.S. Pat. No. 7,171,900, which is hereby incorporated by reference herein, describes a digital ink rail inking unit that includes a plurality of ink valves.

U.S. Patent Publication 2007/0125246 discloses a complex method for measuring and controlling the color value of one or more colored image portions which are printed on a planar substrate in a plurality of ink zones that extend across a width of the substrate. The method includes dividing pixellated digital data into a plurality of digital paths corresponding to each of said ink zones, each digital path comprising a plurality of digital zones, and further dividing the pixellated digital data into color layers. The method also includes analyzing each of the color layers within each of the digital paths to determine a maximum pixel population area for each color within each of said digital paths.

BRIEF SUMMARY OF THE INVENTION

A color control system for use in a printing press is provided. The system includes a controller for reviewing digital data for a print job and identifying solid color regions of the print job that are greater than a predetermined size, a user interface allowing an operator to select solid color regions identified by the controller, a sensor for measuring a characteristic of the selected solid color regions of the print job, on a printed substrate, the controller determining measured values of the characteristic for each of the selected solid color regions, and at least one inking unit for supplying ink in a plurality of ink zones to a plate cylinder, the controller varying the ink supplied to ink zones including the solid color regions as function of a difference between the measured value of the characteristic of each selected solid color region and a predetermined target value of the characteristic.

A method for controlling printing of a printing press is also provided. The method includes identifying solid color regions of an image for a print job that are larger than a predetermined size, presenting the identified solid color regions to an operator of the printing press for selection and receiving input of selected solid color regions for closed loop control during the print job from the operator, printing the image of the print job on a substrate, measuring a characteristic of the selected solid color regions of the printed image and automatically adjusting ink supplied to print the selected solid color regions based on the measurements by the sensor.

BRIEF DESCRIPTION OF THE DRAWINGS

The present invention is described below by reference to the following drawings, in which.

DETAILED DESCRIPTION

Color bars may advantageously be eliminated by measuring the optical density of solid color regions printed on the printing substrate in the desired printed image (i.e., the image displayed in final printed product). In printing certain substrates, such as packaging substrates, the use of color bars may not be tolerated, due to the substrate waste involved and due to objections by customers to color marks appearing in their print on the product.

Embodiments of the present invention may utilize digital data from a print job to be printed to identify solid color regions in an image to be printed on the printing substrate. In one preferred embodiment, an optical density of the solid color regions of a print job may be measured on the printed substrate to determine if color control adjustments need to be made during printing of the print job. The optical density measured in the identified solid color region is used to adjust the ink in the ink zone that includes the solid color region. The solid color regions measured do not have to be contiguous across the printed substrate for the color system to use the solid color regions for closed loop control the amount of ink supplied to the ink zone. For a single inking unit, some ink zones may be controlled automatically by a closed loop control and other ink zones may be controlled manually by an operator during the same print job and at the same time. The method of closed loop control described herein may be advantageously simple because image data is only analyzed for solid color areas above a predetermined size limit. Unlike prior art methods, such as that described in U.S. Patent Publication 2007/0125246, embodiments of the present invention may not require complex analysis of digital image data, including separating digital data in separate color layers and comparing every pixel in each ink zone, and ink zones that do not include solid color regions are not automatically controlled in a close loop system and may be simply adjusted manually by an operator controlling the amount of ink supplied. As used herein manually includes via use of a computer interface. Additionally, the present method allows an operator to remove ink zones from automatic control.

Figure 1:
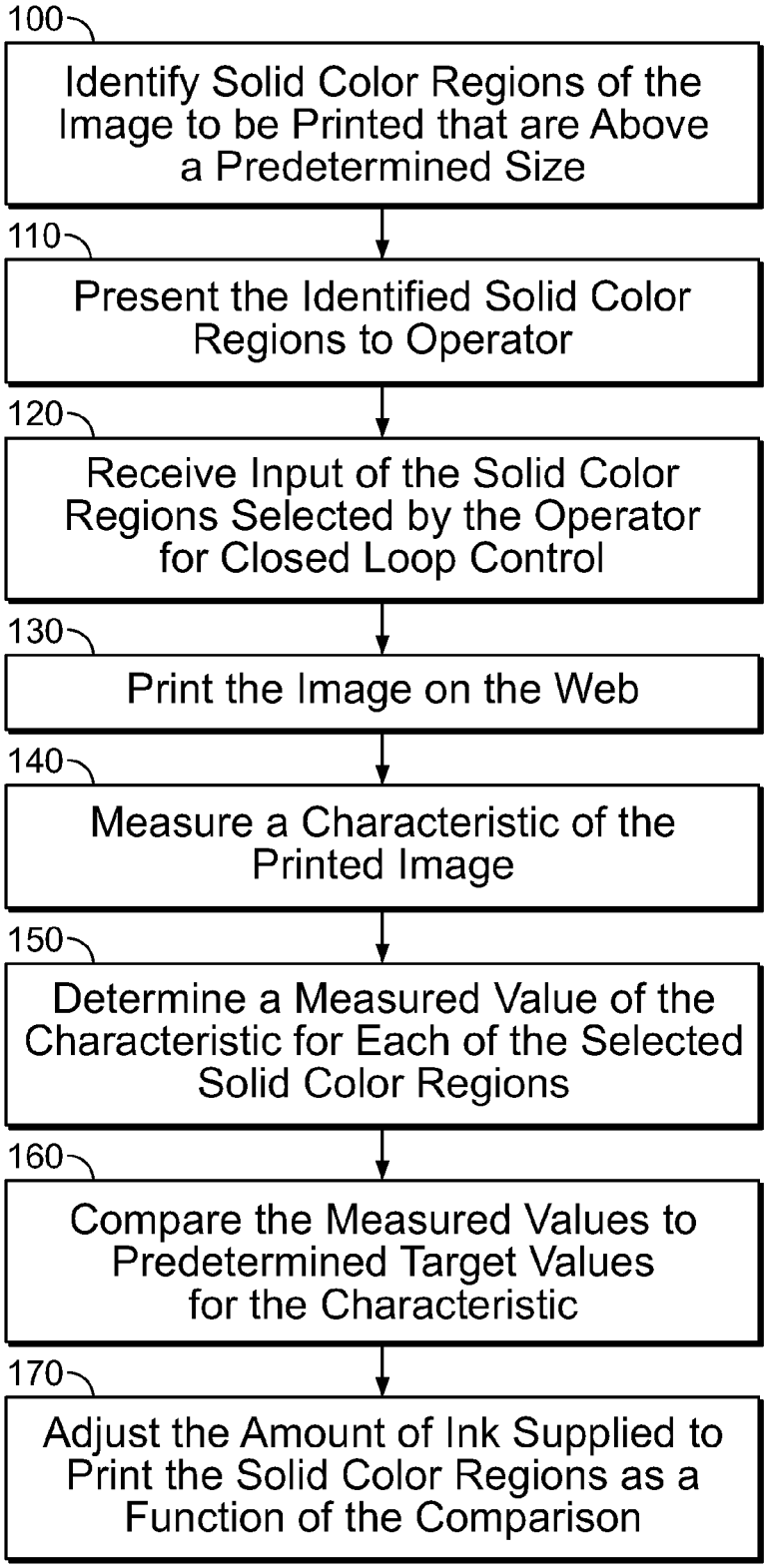
FIG. 1 shows a flow chart illustrating steps of a method according to an embodiment of the present invention.

FIG. 1 shows a flow chart illustrating steps of a method according to an embodiment of the present invention. In a first step 100, image data of a print job is analyzed by a controller to determine solid color regions of image to be printed during the print job that are above a predetermined size limit, which in a preferred embodiment is 4 square mm. The solid color regions above the predetermined size limit may be identified by file parsing image data or as an output from a raster image processor.

Next, in a step 110, the images of the print job are displayed on a user interface to an operator of a printing press used to print the print job. The solid color regions determined in step 100 may be highlighted, for example via an electronic highlighting marker, or clearly indicated in another manner recognizable on the user interface to the operator. The identified solid color regions may then be selected by the operator for closed loop control during the print job. The operator may select all of the indicated solid color regions or less than all of the identified solid color regions. For example, if two solid color regions are identified in a single ink zone, each in a different circumferential plane or the ink zone, the operator may choose to only select one of the solid color regions or may select both solid color regions. In a step 120, the controller receives inputs regarding the solid color regions selected by the operator. The operator then may manually control the ink zones that do not include any selected solid color regions.

In a step 130, which may be performed before, during or after step 100, a substrate is printed with the images of the print job. In a step 140, a characteristic of images printed on the substrate are measured and in a step 150 measured values of the characteristic of the selected solid color regions are determined. In a preferred embodiment, the characteristic is optical density. In a step 160, the measured values of the characteristic of the selected solid color regions are compared to corresponding predetermined values of the characteristic for each selected solid color region. In a step 170, ink keys or ink valves regulating the supply of ink to print the selected solid color regions are then automatically adjusted to increase or decrease the ink corresponding to the solid colors in the corresponding ink zones so that the measured values of the characteristic of the selected solid color regions substantially equal the target values.

Figure 2:
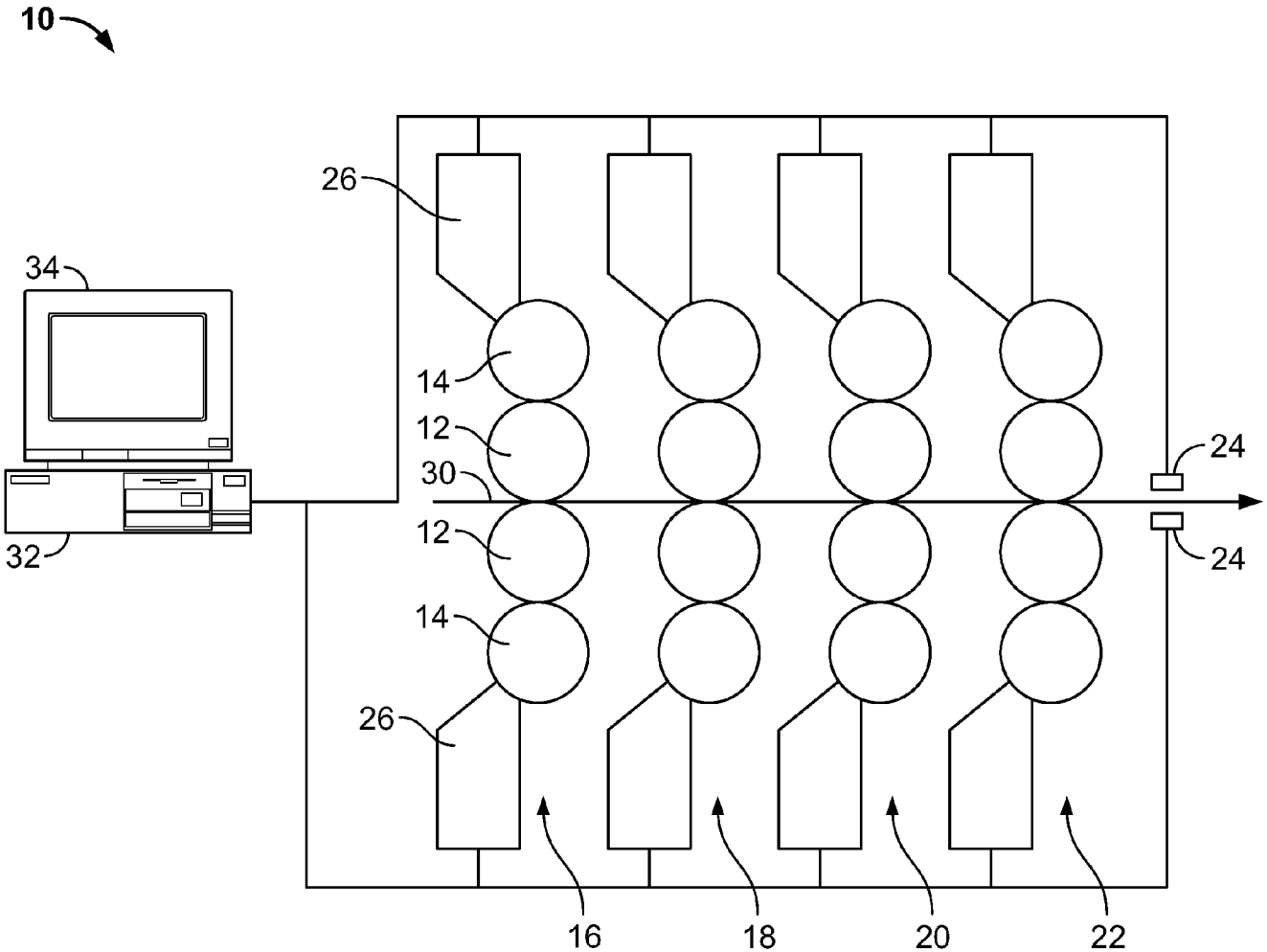
FIG. 2 schematically shows a printing press according to an embodiment of the present invention.

FIG. 2 schematically shows a printing press 10 according to an embodiment of the present invention. Printing press 10 includes four printing units 16, 18, 20, 22, each including two plate cylinders 14 and two blanket cylinders 12. Printing units 16, 18, 20, 22 operate together to print four color images on a moving web 30, with for example printing unit 16 printing black ink, printing unit 18 printing cyan ink, printing unit 20 printing magenta ink and printing unit 22 printing yellow ink. One or more additional printing units may also be provided to print one or more special colors on web 30. Special colors are those that are used instead of process colors black, cyan, magenta and yellow to enable the printing of special hues without mixing the primary colors (e.g., special colors are often used for metallic and other special effects colors). Printing units 16, 18, 20, 22 also each include two inking units 26, which are shown schematically in FIG. 3, for providing respective colored inks to plate cylinders 14 on both sides of web 30. Inking units 26 may for example each be an open fountain inking unit as described in incorporated by reference U.S. Patent Publication 2007/0151470 and each include an ink reservoir, an inking roller, an ink pick up roller and ink distributor rollers, which transfer ink to corresponding printing plates 16, or inking units 26 may for example each be a digital ink rail inking unit as described in incorporated by reference U.S. Pat. No. 7,171,900 and each include an ink rail, a fountain roller, ink transfer rollers and ink form rollers, which transfer ink to corresponding printing plates 16. Each inking unit 26 includes the same number of ink zones and all of the ink zones are of the same width such that the ink zones of each inking unit 26 correspond to the ink zones of each of the other inking units 26. Accordingly, the images printed by printing press 10 can be said to have ink zones that correspond the ink zones of inking units 26. Each inking unit 26, depending on whether the inking unit is an open fountain inking unit or a digital ink rail inking unit, may include a plurality of ink keys or ink valves, with each ink key or ink valve regulating the flow of ink to a respective ink zone.

During operation of printing press 10, an optical density sensor 24 senses the optical density of images printed on web 30 by printing units 16, 18, 20, 22 as instructed by a controller or computer 32. Controller 32 analyzes a digital file of the print job to be printed and identifies regions of the images to be printed on web 30 that include ink of one solid color. Accordingly, controller 32 by file parsing or as the output from a raster image processor, identifies regions of the image to be printed or being printed that includes solid color patches of black, cyan, magenta or yellow (or also the solid color patches of the special colors if one or more special colors are printed on web 30) that are above a predetermined size, which in a preferred embodiment is 4 square mm. The image of the print job is then displayed to an operator of printing press 10 on a user interface 34 in a manner that highlights the solid color regions having an area above the predetermined size. Ink zones of each inking unit may be displayed separately from one another. In a preferred embodiment, user interface 34 is a touchscreen display and the operator may select regions for closed loop control by touching the touchscreen display. The operator the selects which solid color regions are to be monitored for closed loop control by controller 32 and which solid color regions are to be controlled manually by the operator. The coordinates of the solid color regions are passed to the controller 32 in two dimensions—the ink zone and the circumferential reference position in microns or encoder counts with reference to a zero circumferential reference point. The operator may manually control the ink zones that do not include any selected solid color regions using the touchscreen.

For the solid color regions selected to be automatically controlled, controller 32 receives the optical density measurements from sensor 24 and based on the circumferential positions and ink zone positions of the solid color regions, determines the measured optical density for each of the selected solid color regions. Controller 32 then compares the measured optical density for each selected solid color region to the predetermined target optical density for each selected solid color region and adjusts the respective ink keys or valves in the respective inking unit 26. For example, if controller 32 determines that the measured optical density of a solid cyan region in an ink zone is greater than the predetermined target optical density for that solid cyan region, the corresponding ink key or ink valve is adjusted by controller 32 to decrease the amount of ink supplied to that ink zone by the inking unit 26 of printing unit 18. If another solid cyan region in another ink zone has a measured optical density that is less that the predetermined optical density, controller 32 adjusts the corresponding ink key or ink valve to increase the amount of ink supplied to the corresponding ink zone by inking unit 26 of printing unit 18. If more than one solid color region for a particular color is measured in one ink zone, the average of the measured values may be compared with the target value for the corresponding ink zone and the supply of ink is adjusted such that the average values of the measured values equals the target value.

For example if the measured optical density of a selected yellow solid region in a first ink zone is less than a target optical density for solid yellow printing, a controller receiving the measured solid yellow optical density and comparing the measured solid yellow optical density to the predetermined target solid yellow optical density automatically adjusts the position of the first ink key or ink valve in the yellow printing unit to increase the amount of yellow ink supplied to the first ink zone. Also, if a magenta solid region of the same image is also selected in a second ink zone (in the same or different circumferential area of the image), the controller receiving the controller receiving the measured solid magenta optical density and comparing the measured solid magenta optical density to the predetermined target solid magenta optical density automatically adjusts the position of the second ink key or ink valve in the magenta printing unit to increase the amount of magenta ink supplied to the second ink zone.

Figure 3:
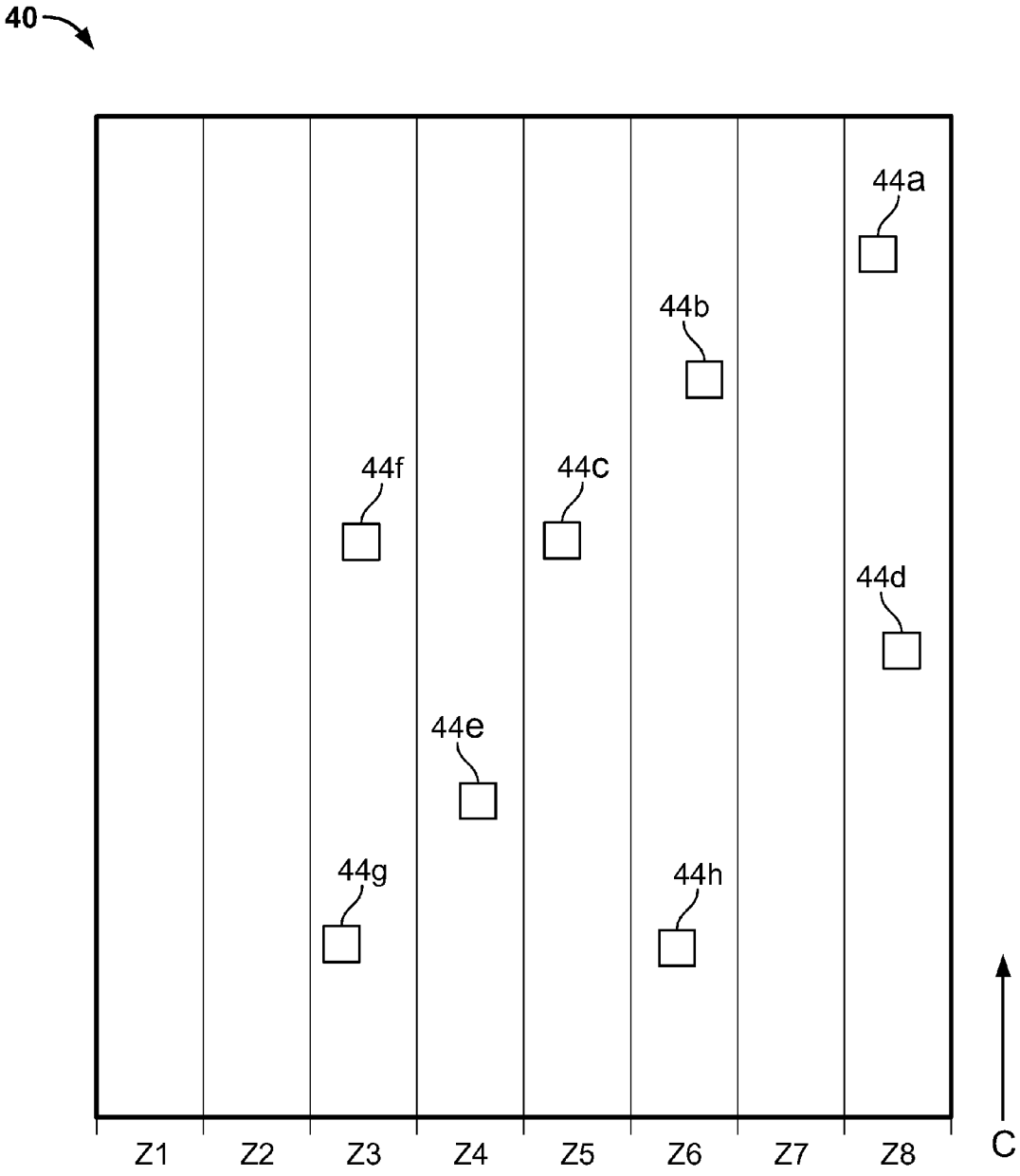
FIG. 3 schematically shows a four color image including a plurality of solid color regions.

As known by one of skill in the art, a circumferential dimension of an image is a term that is used in relation to the longitudinal dimension of an image and refers to the positions of the image information imaged onto plates on the circumferences of the plate cylinders. It should be noted that the selected solid color regions of different ink zones do not have to be in the same circumferential plane of the image. For example, as shown in FIG. 3, a four color image to be printed by a four color printing press may include a plurality of solid color regions 44*a* to 44*h*, which vary in location along a circumferential dimension C. In FIG. 3, image 40 is shown schematically divided into eight ink zones Z1 to Z8 that correspond to zones of ink keys or ink valves that control how much ink is fed from an ink fountain to rollers of an inking unit. The number of ink zones described herein is only exemplary and the number of ink zones in the example described herein is small for ease of description. In one preferred embodiment, there are 46 ink zones in each inking unit. For clarity, the actual images imaged on plate 40 are not shown. The rollers of the inking unit provide the ink to printing plate 40. For example, solid color regions 44*a*, 44*b* may be yellow, solid color regions 44*c*, 44*d*, 44*e* may be magenta, solid color region 44*f* may be cyan and solid color regions 44*g*, 44*h* may be black.

As shown in FIG. 3, ink zones Z1, Z2 and Z7 do not include any solid color regions and thus the ink flow into zones Z1, Z2 and Z7 for each inking unit may be set for manual control. Ink zone Z3 includes solid black region 44*g* and solid cyan region 44*f*. Accordingly, for ink zone Z3, the ink key or valve for the black inking unit and the ink key or valve for the cyan inking unit are controlled automatically based on the optical density values of respective regions 44*g*, 44*f* and the ink keys or ink valves for the magenta and yellow inking units are set for manual control. Ink zones Z4, Z5 include solid magenta regions 44*e*, 44*c*, respectively. Accordingly, for ink zones Z4, Z5, the ink keys or ink valves for the magenta inking unit are controlled automatically based on the optical density values of regions 44*e*, 44*c* and the ink keys or ink valves for the black, cyan and yellow inking units are set for manual control. Ink zone Z6 includes solid yellow region 44*b* and solid black region 44*h*. Accordingly, for ink zone Z6, the ink key or valve for the yellow inking unit and the ink key or valve for the black inking unit are controlled automatically based on the optical density values of respective regions 44*b*, 44*h* and the ink keys or ink valves for the cyan and magenta inking units are set for manual control. Ink zone Z8 includes solid yellow region 44*a* and solid magenta region 44*d*. Accordingly, for ink zone Z8, the ink key or valve for the yellow inking unit and the ink key or valve for the magenta inking unit are controlled automatically based on the optical density values of respective regions 44*a*, 44*d* and the ink keys or ink valves for the black and cyan inking units are set for manual control.

Figure 4:
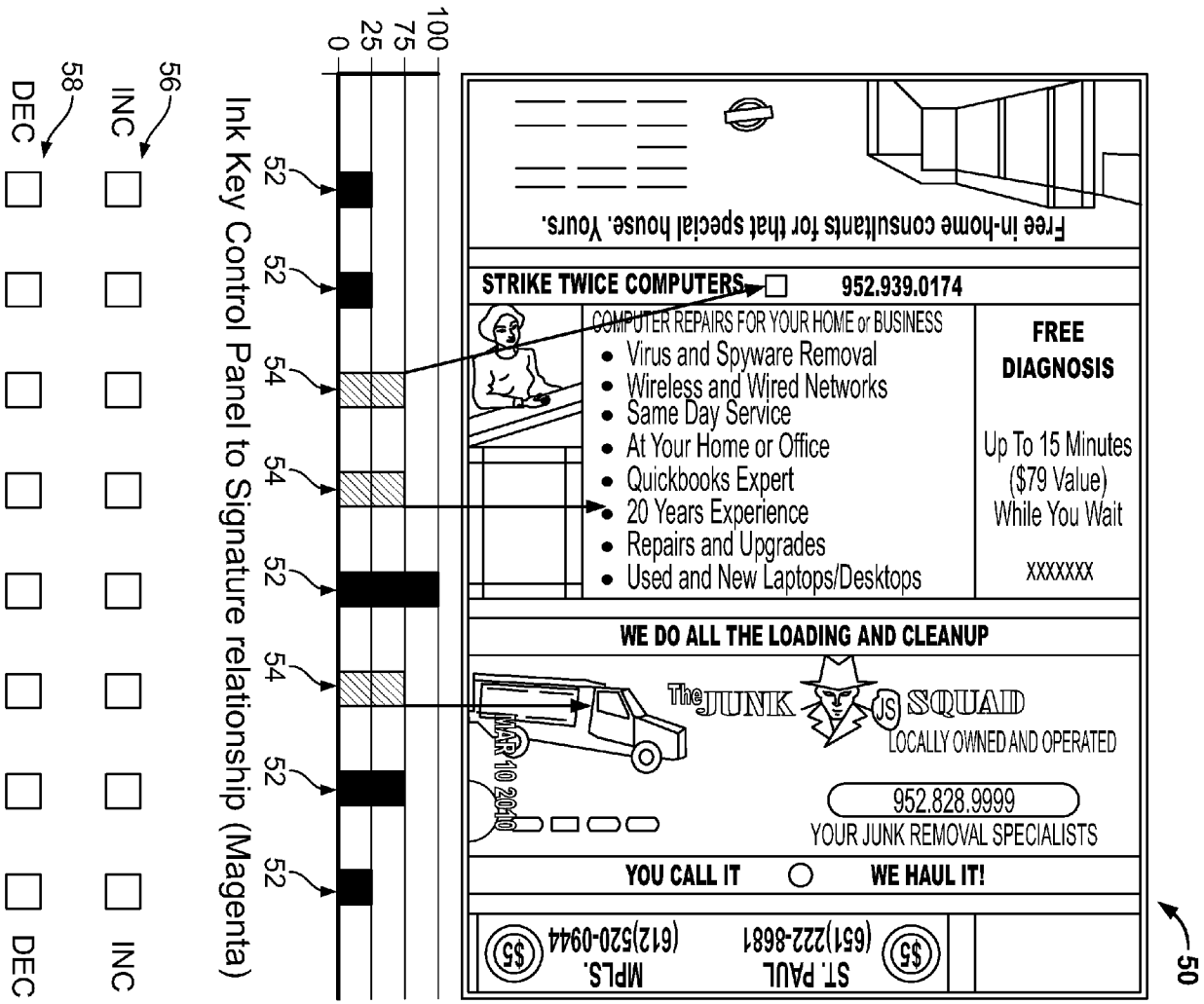
FIG. 4 shows a screen shot of a user interface according to an embodiment of the present invention.

FIG. 4 shows a screen shot 50 of user interface 34 according to an embodiment of the present invention showing a sample image. Simulated ink zones for magenta ink are shown below the sample printed image on interface 34, with the solid marked boxes 52 illustrating keys or valves that will be controlled manually by the operator and the hash marked boxes 54 illustrating keys or valves that will be controlled automatically via closed loop control by controller 32 (FIG. 3). Arrows are shown in the automatically controlled ink zones pointing to the solid color regions of the sample printed image used for the closed loop controls. For each ink zone to be manually controlled, the operator can press buttons 56 to increase the amount of ink supplied to the corresponding ink zone or can press buttons 58 to decrease the amount of ink supplied to the corresponding ink zone. For the ink zones being controlled automatically, buttons 56, 58 are set as inactive.

As used herein, solid color regions are regions that include only a single color and are approximately 100% halftone density.

In the preceding specification, the invention has been described with reference to specific exemplary embodiments and examples thereof. It will, however, be evident that various modifications and changes may be made thereto without departing from the broader spirit and scope of invention as set forth in the claims that follow. The specification and drawings are accordingly to be regarded in an illustrative manner rather than a restrictive sense.

What is claimed is:

1. A color control system for use in a printing press comprising:

a controller for reviewing digital data for a print job including solid color regions of the print job that are greater than a predetermined size and identifying solid color regions of the print job that are greater than the predetermined size;

a user interface allowing an operator to select solid color regions identified by the controller;

a sensor for measuring a characteristic of the selected solid color regions of the print job on a printed substrate, the controller determining measured values of the characteristic for each of the selected solid color regions; and at least one inking unit for supplying ink in a plurality of ink zones to a plate cylinder, the controller varying the ink supplied to ink zones including the solid color regions as function of a difference between the measured value of the characteristic of each selected solid color region and a predetermined target value of the characteristic.

2. The color control system recited in claim 1 wherein the solid color regions identified by the controller consist of regions that include only one of black ink, cyan ink, magenta ink or yellow ink.

3. The color control system recited in claim 1 wherein the operator user interface is a touchscreen display allowing the ink zones including solid color regions for each color ink to be selected to be controlled by the controller are selected independently of the ink zones of the other colors of ink.

4. The color control system recited in claim 1 wherein the ink zones that are not identified by the controller as having solid color regions are displayed to the operator as inactive and are not selectable by the user via the operator user interface.

5. The color control system recited in claim 1 wherein the at least one inking unit includes a first color inking unit, a second color inking unit, a third color inking unit and a fourth color inking unit, each inking unit including a plurality of ink zones that are separately controllable by the controller, the controller controlling only the ink supplied to ink zones including selected solid color regions.

6. The color control system recited in claim 5 wherein the controller automatically controls the ink supplied to only some of the ink zones of the first color inking unit, the second color inking unit, the third color inking unit and the fourth color inking unit and sets the other of the ink zones of the first color inking unit, the second color inking unit, the third color inking unit and the fourth color inking unit for manual control by the operator.

7. The color control system recited in claim 1 wherein the sensor is an optical density sensor.

8. The color control system recited in claim 1 wherein the at least one inking unit includes ink keys or ink valves and the controller controls operation of the ink keys or ink valves that supply ink to the selected solid color regions.

9. A method for controlling printing of a printing press:

providing digital data for a print job including an image having solid color regions of the print job that are greater than a predetermined size identifying solid color regions of the image for the print job that are larger than a predetermined size;

presenting the identified solid color regions to an operator of the printing press for selection and receiving input of selected solid color regions for closed loop control during the print job from the operator;

printing the image of the print job on a substrate;

measuring a characteristic of the selected solid color regions of the printed image; and automatically adjusting ink supplied to print the selected solid color regions based on the measurements by the sensor.

10. The method recited in claim 9 wherein the printing press includes a plurality of inking units, each inking unit including the same number of ink zones and ink zones of the same width, such that the ink zones of each inking unit correspond to the ink zones of each of the other inking units, the selected solid color regions being in at least one of the ink zones, but not all of the ink zones.

11. The method recited in claim 10 wherein the selected solid color regions are in at least one of the ink zones of each inking unit.

12. The method recited in claim 8 wherein the selected solid color regions include two or more solid color regions in one of the ink zones.

13. The method recited in claim 1 wherein the printing press includes a plurality of inking units having ink zones and the adjusting includes adjusting ink zones for each of the inking units independently of one another.

14. The method recited in claim 9 wherein the plurality of inking units includes a first color inking unit, a second color inking unit, a third color inking unit and a fourth color inking unit, each inking unit including a plurality of ink zones, the automatically adjusting step including adjusting only the ink supplied to ink zones including selected solid color regions.

15. The method recited in claim 14 wherein the automatically adjusting step includes adjusting the ink supplied to only some of the ink zones of the first color inking unit, the second color inking unit, the third color inking unit and the fourth color inking unit.

16. The method recited in claim 15 further comprising setting the other of the ink zones of the first color inking unit, the second color inking unit, the third color inking unit and the fourth color inking unit for manual control.

17. The method recited in claim 14 wherein the printed images include a circumferential dimension and the selected solid color regions are distributed in a plurality of different positions of the circumferential dimension.

18. The method recited in claim 9 wherein the predetermined size is 4 square mm.

* * * * *